United States Patent [19]

Greive et al.

[11] 4,391,087

[45] Jul. 5, 1983

[54] TWISTING APPARATUS

[75] Inventors: Aloys Greive, Münster; Aloys Horstmann, Greven; Wilhelm Stupirak, Münster, all of Fed. Rep. of Germany

[73] Assignee: Volkmann GmbH & Co., Krefeld, Fed. Rep. of Germany

[21] Appl. No.: 254,764

[22] Filed: Apr. 16, 1981

[30] Foreign Application Priority Data

Apr. 18, 1980 [DE] Fed. Rep. of Germany ..... 3015044

[51] Int. Cl.[3] ..... D01H 1/10; D01H 7/86

[52] U.S. Cl. ..... 57/58.52; 57/58.83

[58] Field of Search ..... 57/58.49, 58.52, 59, 57/58.54, 58.83

[56] References Cited

U.S. PATENT DOCUMENTS

| | | | |
|---|---|---|---|
| 2,022,424 | 11/1935 | Langwieler | 57/58.49 |
| 2,076,762 | 4/1937 | Bochmann | 57/58.49 X |
| 3,742,693 | 7/1973 | Greive et al. | 57/58.52 X |
| 3,807,156 | 4/1974 | Gre | 57/58.52 |

*Primary Examiner*—Donald Watkins

*Attorney, Agent, or Firm*—Karl F. Ross; Herbert Dubno

[57] ABSTRACT

A twisting apparatus has a spindle extending along an upright axis, having an upper end and a rotatable lower end, and formed with a passage opening axially upwardly at the upper end and radially outwardly at the lower end. A bobbin support is rotatably carried on the spindle between the ends thereof and is provided with four angularly equispaced bobbin holders radially equispaced from the axis. Two of the diametrally opposite supports carry main bobbins and the other two carry reserve bobbins, with the leading ends of the yarns of the reserve bobbins being tied to the tail ends of the yarns of the main bobbins. The spindle is rotated about the axis while the bobbin support is held against rotation. The leading ends of the yarns of the main bobbins are led down through the passage and up around the bobbin support while the spindle is rotating to wind the yarns together and form a balloon around the support. The bobbins can be standard small-diameter bobbins such as come directly from a spinning machine.

10 Claims, 6 Drawing Figures

TWISTING APPARATUS

FIELD OF THE INVENTION

The present invention relates to a twisting apparatus and to a method of operating it. More particularly this invention concerns such an apparatus which twists together two yarns to form a two-ply thread.

BACKGROUND OF THE INVENTION

It is known, as for example from earlier commonly owned patent application Ser. No. 191,024 filed Sept. 26, 1980, to twist together a pair of yarns by pulling the yarns off superposed concentric yarn packages carried on a spindle. This spindle extends along an upright axis, has an upper end and a rotatable lower end, and is formed with a passage opening axially upwardly at the upper end and radially outwardly at the lower end. This spindle is driven for rotation about its axis while the yarn packages or bobbins are rotatably carried on a bobbin support that is carried on the spindle between its ends. The bobbin support is prevented from rotating while the spindle is rotated, with the two filaments pulled off the respective yarn packages passing axially down through the passage and radially out through its lower passage end, then up axially around the bobbin support to form a so-called balloon around the bobbin support.

Such an apparatus can relatively easily twist together two yarns to form a thread suitable for knitting or weaving. The two yarns can be of opposite twist so that the resultant thread has a tensile strength substantially greater than the sum of the tensile strength of the two yarns.

The disadvantage of this system is that it is necessary to use standard yarn packages that can be slipped axially down over the spindle one atop the other, or to use a yarn package on which two yarns are wound. It is regrettably impossible to use the standard small-diameter bobbins or so-called cops such as are used in a spinning operation. It is therefore normally necessary to rewind the yarn after spinning from the small-diameter bobbin on which it is spun onto a larger-diameter bobbin for use in the twisting apparatus.

Another disadvantage of the known machines is that they must be frequently reloaded. When the supply on one of the bobbins runs out the machine must be shut down and reloaded.

OBJECTS OF THE INVENTION

It is therefore an object of the present invention to provide an improved twisting apparatus and method of operating same.

Another object is to provide such an apparatus which not only can use the small-diameter bobbins customarily employed in spinning, but which can also be set up to use a reserve bobbin.

SUMMARY OF THE INVENTION

These objects are attained according to the instant invention in a twisting apparatus whose bobbin support is provided with a plurality of bobbin holders spaced about and radially offset from the spindle axis and each adapted to support a respective bobbin carrying a respective yarn. Thus instead of having the yarn packages or bobbins mounted concentrically on the spindle of the twisting machine, they are mounted around this support. As a result it is possible to load the machine with the relatively small bobbins employed in spinning.

According to further features of this invention the bobbin holders are angularly equispaced about the spindle axis on the bobbin support. Normally four such bobbin holders are provided, for two main bobbins and two reserve bobbins, with the main bobbins diametrically opposite each other.

According to the method aspects of the instant invention, each of the yarns of the main bobbins has its tail end tied to the leading end of the respective reserve-bobbin yarn, so that when the yarn runs out on the main bobbin the device will continue to operate, pulling the yarn off the reserve bobbin. In this manner it is possible greatly to increase the capacity of the system so that it runs twice as long between reloadings.

According to the instant invention a guide eye may be provided above each of the bobbin holders, with the guide eye of each main-bobbin holder open horizontally toward the guide eye of the respective reserve-bobbin holder. The yarn is passed from each reserve bobbin up through its respective eye, then down adjacent the respective main-bobbin holder to an upwardly open clip where it is tied with the tail end of the yarn from the main bobbin. Thus when the main-bobbin yarn runs out the yarn will automatically pull out of its eye and thereafter will feed through the guide eye for the reserve bobbin.

This effect may also be achieved according to the instant invention by providing a single displaceable guide eye movable from a position above and aligned with the respective main-bobbin holder and a position above and aligned with the respective reserve-bobbin holder. Thus when the main-bobbin filament runs out this guide eye will simply pivot around to above the respective reserve-bobbin holder whereupon the feed will continue. An adjustable friction brake is provided for inhibiting such pivotal displacement of the guide eye with an adjustable force, so that excessive vibration or motion of the guide eyes is avoided.

It is possible with the system according to this invention to use bobbins having heights of between 300 and 800 mm, normally between 400 and 650 mm, and diameters when fully wound between 80 and 150 mm, normally between 100 and 120 mm. Typically wind-up bobbins of the type used on a ring-spinning device can be used directly on the twisting machine according to the instant invention. Thus it is unnecessary to rewind the yarns onto appropriate packages for subsequent doubling or twisting.

According to the instant invention the support is provided with a plurality of shield plates which lie between the bobbins, so that the yarn being pulled off one bobbin cannot become fouled with the yarn of an adjacent bobbin. These shield plates extend axially out from the center and define radially outwardly open compartments. Changing bobbins is facilitated by providing a relatively short balloon-limiting sleeve surrounding the entire assembly, which sleeve has an axial height equal to at most one-quarter the overall axial height of the assembly. Thus the assembly is relatively open and easy to service.

In accordance with a further feature of this invention a yarn-guide assembly is provided which incorporates the abovedescribed eyes and which is releasably mounted on top of the bobbin support. This assembly can incorporate an outside ring that prevents the balloon from becoming enmeshed with the filaments as they are pulled up from the bobbins into the central upper end of the spindle. In addition such an assembly may incorporate a multiply bent wire that forms the abovedescribed eyes that are open toward one another, or may carry the pivot for a pivotal eye.

SPECIFIC DESCRIPTION

Figure 1:
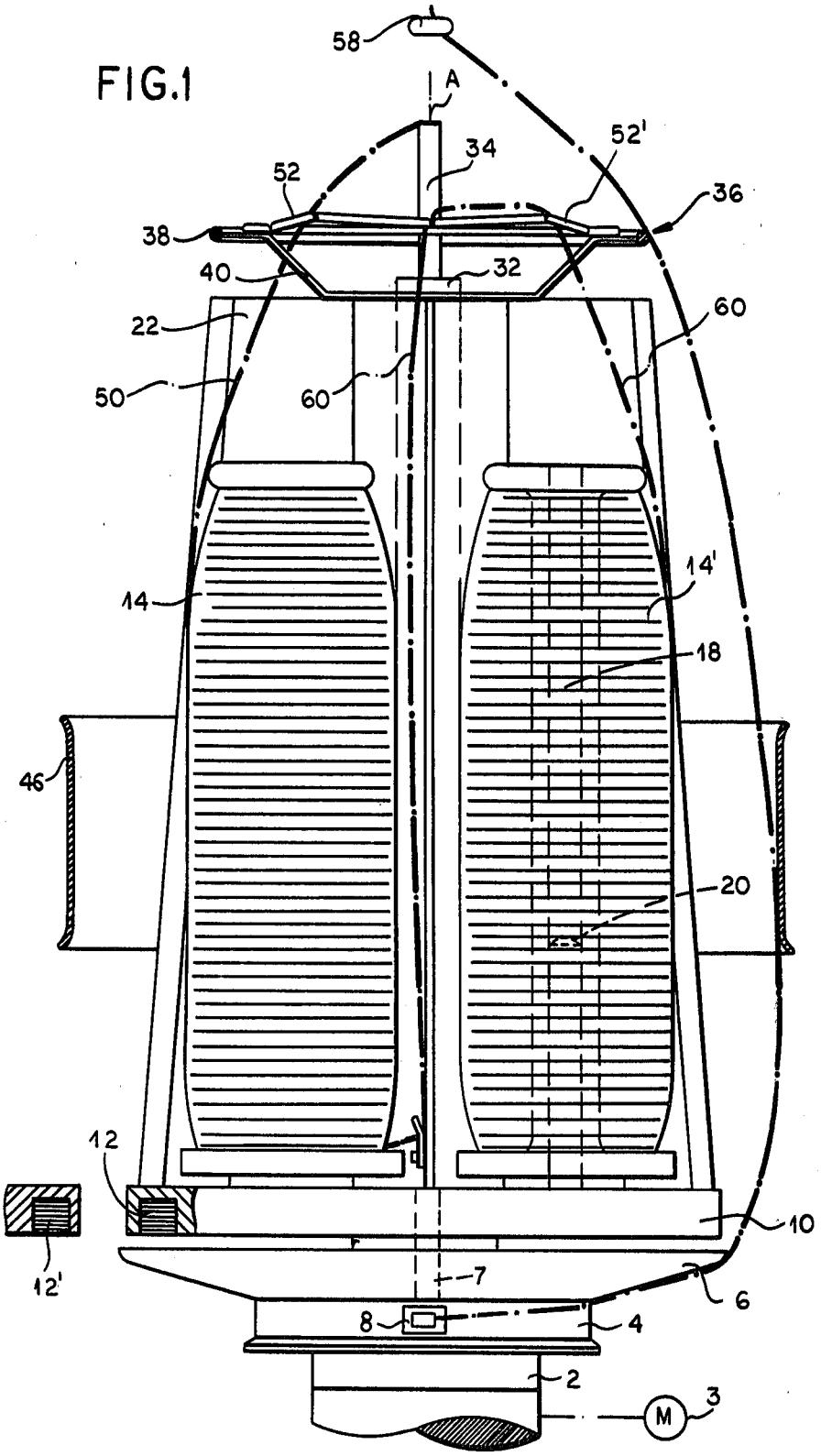
FIG. 1 is a side partly schematic and partly sectional view of an apparatus according to this invention.

As seen in FIGS. 1–4 a twisting apparatus has an upright spindle 2 centered on an axis A and rotatable thereabout by a motor 3 normally connected to a whorl on the spindle 2 by means of a flat belt. A cylindrical storage drum 4 provided immediately underneath a frustoconical cast-off disk 6 is provided fixed on the spindle 2. The spindle 2 is formed with a central passage 7 that extends along the axis A, opening at the upper end of a tube 34 forming the extreme upper portion of the spindle 2, and at its lower end at a radially outwardly opening hole 8 on the storage drum 4.

Supported by a nonillustrated bearing on the spindle 2 is a bobbin support or carrier 10 provided at one side with a magnet 12 capable of coacting with a fixed magnet 12' so as to prevent the support 10 from rotating when the shaft 2 is rotated. This support 10 is provided with four upstanding holder pins 20 angularly equispaced about the axis A and radially equispaced from the axis A. Diagonally opposite pins 20 fit into holes 18 of main bobbins 14 and 16, and the intervening pins 20 fit into the holes 18 of reserve bobbins 14' and 16' that like the bobbins 14 and 16 are diagonally or diametrically opposite each other. The bobbins 14, 14', 16 and 16' are of the standard small-diameter type having end flanges.

The support 10 is provided with four shielded plates 22 which are secured to a central square tube 23 surrounding the upper end of the spindle 2. The shields 22 are angularly equispaced and form radially open compartments 24, 26, 28 and 30 for the bobbins 14–16'.

Figure 2:
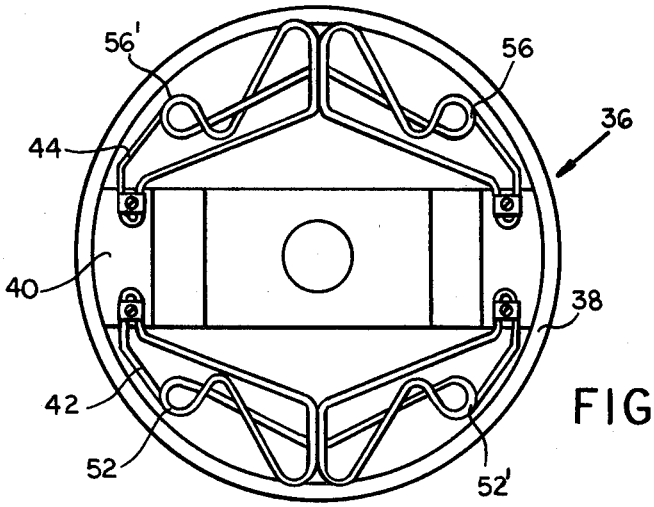
FIG. 2 is a top view of the yarn-guide assembly of FIG. 1.
Figure 3:
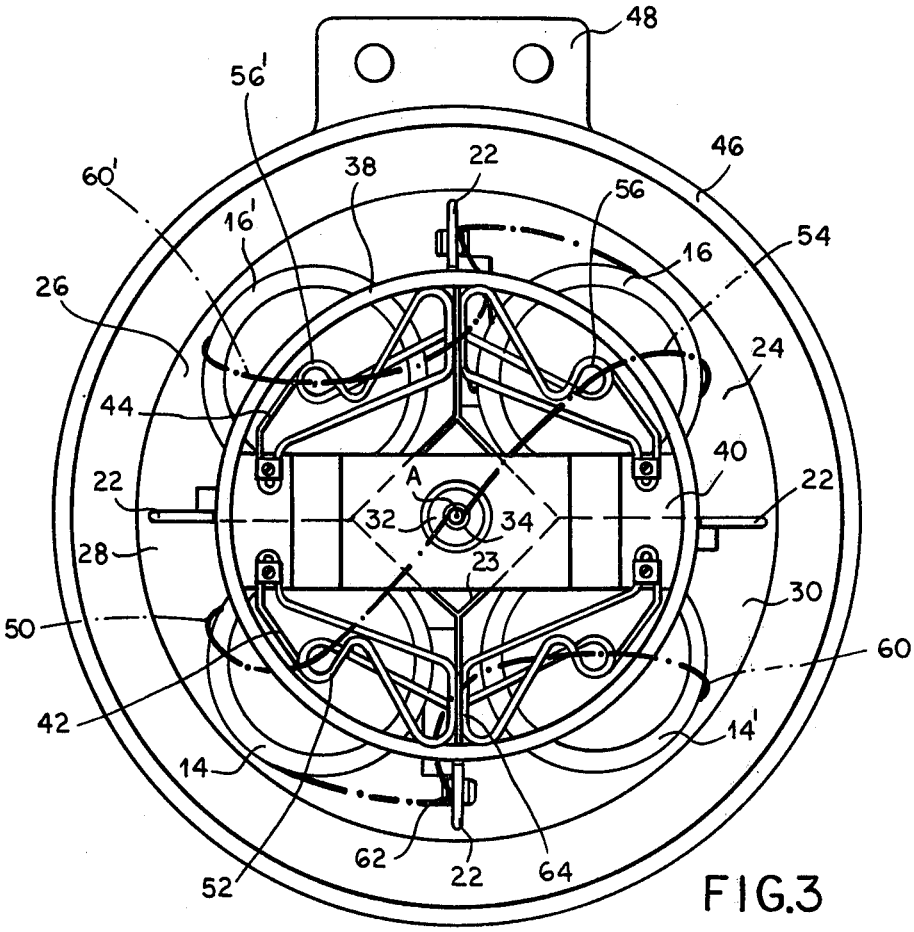
FIG. 3 is a top view of FIG. 1.

A thread brake 32 is provided in the upper end portion 34 of the spindle 2. In addition a yarn-guide assembly 36 shown alone in FIG. 2 is mounted on this upper spindle end 34 by means of a centrally perforated mounting plate 40 which is provided at its outer ends with a heavy guide ring 38 centered on the axis A. In addition this plate 40 carries wires 42 and 44 bent in a manner described below so as to form eyes 52 and 56 above the main bobbins 14 and 16 and eyes 52' and 56' above the reserve bobbins 14' and 16'. A relatively short ballon-limiting sleeve 46 is secured fixedly at 48 adjacent the assembly in the manner well known in the art.

According to this invention a yarn 50 is drawn off the package 14 through the eye 52 and another yarn 54 off the package 16 through the eye 56. These two yarns then pass down through the tube 34 where they pass through the adjustable thread brake 32, then along the passage 7 to where they exit together from the hole 8 on the storage disk 4. The spindle 2 is meanwhile rotating so that as the combined yarns pass up over the storage disk 6 they form a standard balloon within the sleeve 46, and are drawn off through an axially centered takeoff eye 58 provided above the arrangement. This procedure is standard in the art.

According to this invention the tail ends of the filaments 50 and 54 are knotted to the leading ends of the filaments 60 and 60' of the reserve bobbins 14' and 16'. To this end these filaments 60 and 60' pass up through the respective eyes 52' and 56' and over the upper edges 64 of the partitions 22 separating them from the adjacent respective main bobbins 14 and 16. Then they pass down to an upwardly open clip 62 where they are relatively loosely held in place.

In accordance with this invention the eyes 52 and 56 are open in directions toward the respective reserve bobbins 14' and 16'. Thus when all of the yarn 50 or 54 has been pulled off one of the bobbins 14 or 16 the yarn will be pulled out of the clip 62 and will slide out of the eye 52 or 56 so as to pay off afterward from the other eye 52' or 56'. In this manner two separate bobbins can be unwound before the machine according to the instant invention has to be unloaded.

Figure 4:
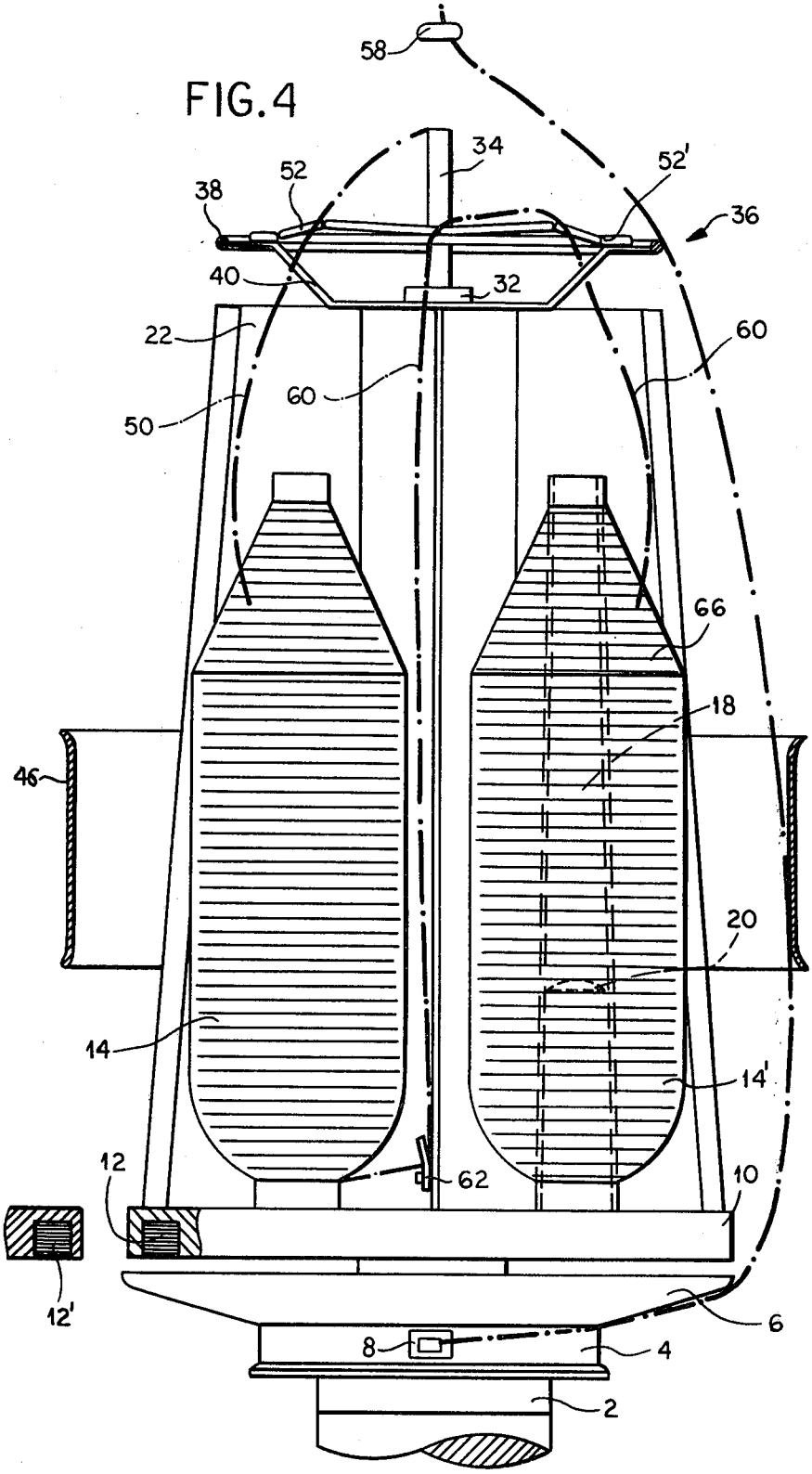
FIG. 4 is a view similar to FIG. 1 showing the apparatus of FIG. 1 with different bobbins.

It is also possible as shown in FIG. 4 to employ bobbins 66 having no end flanges, but of the type wound from one end down as in a spinning machine. Thus it is possible to load the bobbins directly from the spinning machine into the twisting machine, saving a rewinding step normally required.

Figure 5:
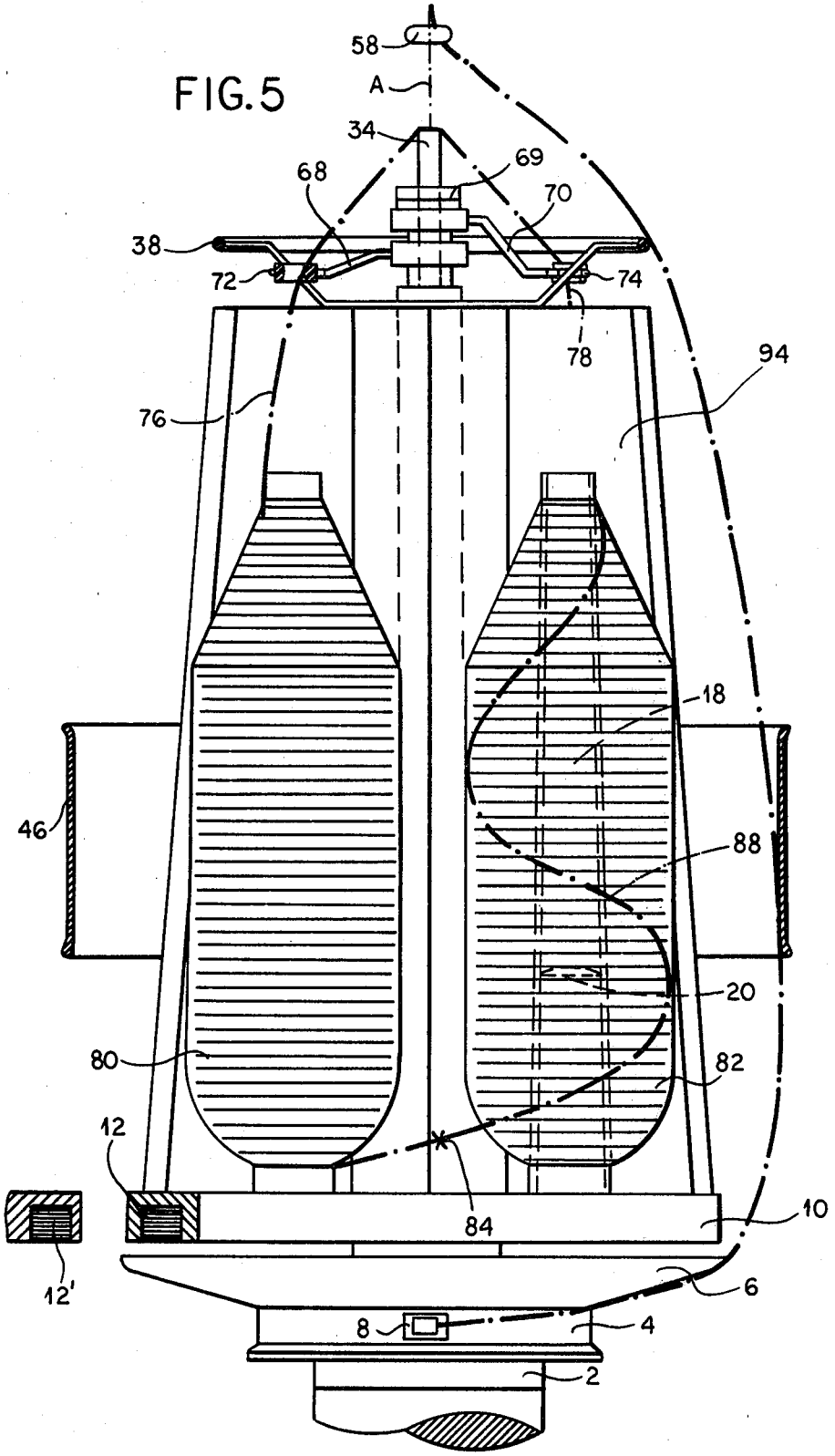
FIG. 5 is a view similar to FIG. 1 showing another arrangement according to this invention.
Figure 6:
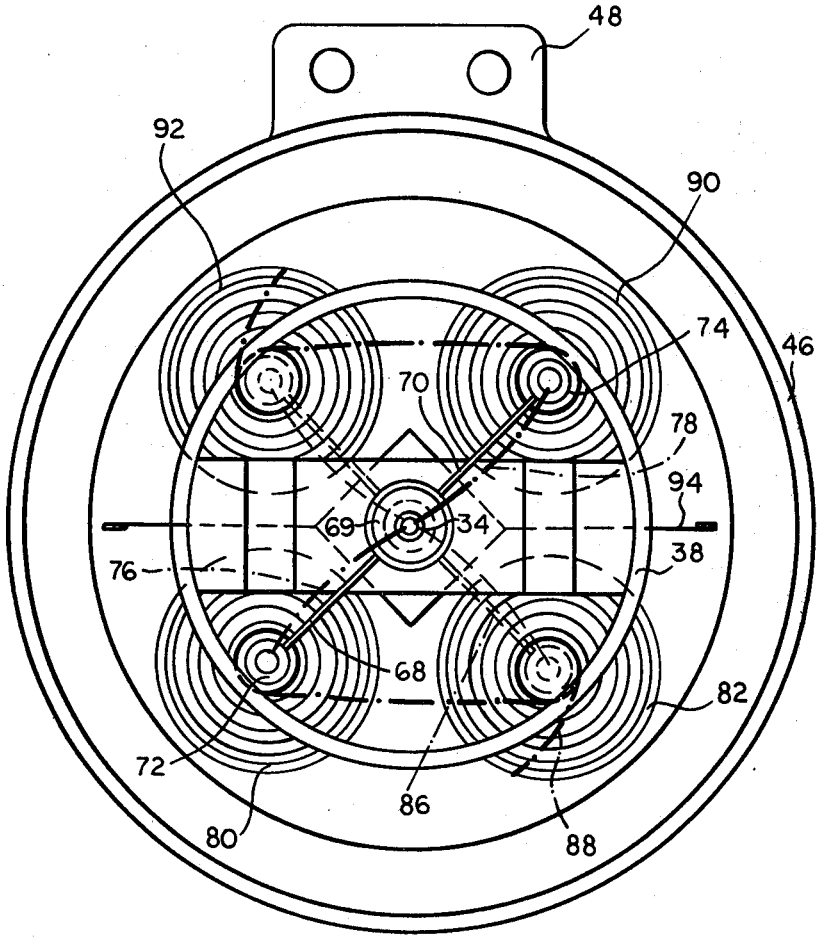
FIG. 6 is a top view of the apparatus of FIG. 5.

FIGS. 5 and 6 show an arrangement substantially indentical to that of FIGS. 1–4, except that the thread guide 36 of FIGS. 1–4 is here replaced by a pair of pivotal arms 68 and 70 held on the upper end 34 of the spindle 2 by a nut 69 which can be tightened to frictionally impede their swinging about the axis A. These arms 68 and 70 carry at their outer ends respective eyes 72 and 74 which can swing between positions aligned with the respective main and reserve bobbins.

Thus as shown in FIG. 5 a yarn 76 pulled off one package 80 passes up through the eye 72 and another yarn 78 pulled of the diametrically opposite yarn package 90 passes up through the respective eye 74 where two yarns are united in the thread brake 32 underneath the upper end 34 of the spindle 2. In addition the yarn 88 from a reserve package 82 is clipped at 84 and tied to the tail end of the yarn 76 from the package 80. The yarn of the other reserve package 92 is similarly connected to the tail end of the yarn 78.

Thus as seen in FIG. 5 when the yarn 76 runs out the arm 68 with its eye 72 can pivot into the dashed-line position shown at 86 in FIG. 6 to allow the added yarn 88 to be pulled straight up off the package 82. The same procedure is followed for the yarns of the bobbins 90 and 92.

Such an arrangement therefore can use standard bobbins directly as they come from the spinning machine. As the yarn is always pulled off the end of the bobbin which has no end plate, only a single diametral partition 94 is needed to prevent the yarns from catching in one another. The system has the advantage of extreme simplicity and is capable of forming an extremely long twisted yarn between reloadings.

Since the main bobbins are diametrally opposite one another as are the reserve bobbins, and since the the support pins 20 are angularly equispaced about the axis A and radially equispaced therefrom, the center of gravity of the assembly will always lie on the axis A. Even if the two main bobbins become depleted the center of gravity will not move from the axis A due to the placement of the holder pins 20. Thus the bearing carrying the support 10 on the rotating spindle 2 will not be unduly loaded.

We claim:

1. A twisting apparatus comprising:

a spindle extending along an upright axis, having an upper end and a rotatable lower end, and formed with a passage opening axially upwardly at said upper end and radially outwardly at said lower end;

means for rotating said spindle about said axis;

a bobbin support rotatably carried on said spindle between said ends thereof and provided with a plurality of bobbin holders spaced about and radially offset from said axis and each adapted to support a respective bobbin carrying a respective yarn, whereby said yarns can be led down through said passage and up around said bobbin support while said spindle is rotating to wind said yarns together and form a balloon around said support; and means for preventing rotation of said support about said axis even while said spindle is rotating, said bobbin holders being angularly equispaced about and radially equispaced from said axis, said bobbin holders number four, including two for main bobbins and two for the reserve bobbins, the holders for said main bobbins being diametrally opposite each other and alternating with the holders for said reserve bobbins.

2. The twisting apparatus defined in claim 1, further comprising an upwardly open yarn clip on said bobbin support between each of said main bobbins and the respective reserve bobbin.

3. The twisting apparatus defined in claim 2, further comprising a guide eye centered above each of said bobbin holders, the eyes of the main-bobbin holders being open laterally toward the respective reserve-bobbin holders.

4. The twisting apparatus defined in claim 3, further comprising a yarn guide assembly removably mounted on said upper end of said spindle and forming said eyes.

5. The twisting apparatus defined in claim 4 wherein said assembly includes a peripheral guide ring centered on said axis and outside said eyes.

6. The twisting apparatus defined in claim 4 wherein said assembly includes at least one bent wire forming said eyes.

7. The twisting apparatus defined in claim 7 further comprising above each main-bobbin holder and the respective reserve-bobbin holder a respective guide eye displaceable between a position above and aligned with the respective main-bobbin holder and a position above and aligned with the respective reserve-bobbin holder.

8. The twisting apparatus defined in claim 7 wherein said guide eyes are pivotal generally about said axis between said positions.

9. The twisting apparatus defined in claim 1, further comprising shield plates on said support between said bobbins.

10. The twisting apparatus defined in claim 1, further comprising a thread brake in said upper end of said spindle.

* * * * *